US006098418A

United States Patent [19]

Kyees

[11] Patent Number: 6,098,418

[45] Date of Patent: Aug. 8, 2000

[54] APPARATUS FOR COOLING FLUIDS

[76] Inventor: Melvin D. Kyees, 16732 Intrepid La., Huntington Beach, Calif. 92649

[21] Appl. No.: 08/933,444

[22] Filed: Sep. 18, 1997

[51] Int. Cl.[7] ..... B67D 5/62

[52] U.S. Cl. ..... 62/399; 62/400; 62/460; 62/464

[58] Field of Search ..... 62/398, 399, 400, 62/390, 459, 460, 461, 464

[56] References Cited

U.S. PATENT DOCUMENTS

Re. 34,834 1/1995 Swanson ..... 62/398
4,617,807 10/1986 Pritchett et al. ..... 62/399

FOREIGN PATENT DOCUMENTS 628858 10/1927 France ..... 62/399

*Primary Examiner*—Ronald Capossela
*Attorney, Agent, or Firm*—Steven P. Shurtz; Brinks Hofer Gilson & Lione

[57] ABSTRACT

An apparatus for cooling at least one fluid includes at least one fluid system comprising at least one fluid line, and a metallic unit. The fluid system is arranged in the shape of a concavely depressed coil with a top and a bottom. At the bottom of the coil an opening is defined. The metallic unit incorporates the at least one fluid system. The metallic unit has an upper surface in which is defined a concave depression, and the concave depression has defined therein a drain which extends through the metallic unit. The concave depression of the metallic unit is aligned with the concavely depressed coil, and the drain defined in the metallic unit passes through the opening at the bottom of the at least one fluid system.

20 Claims, 3 Drawing Sheets

FIG. 4a
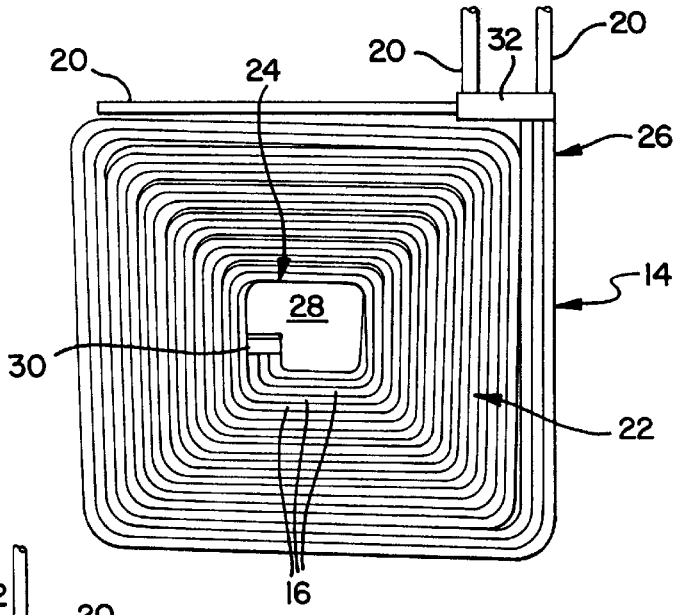
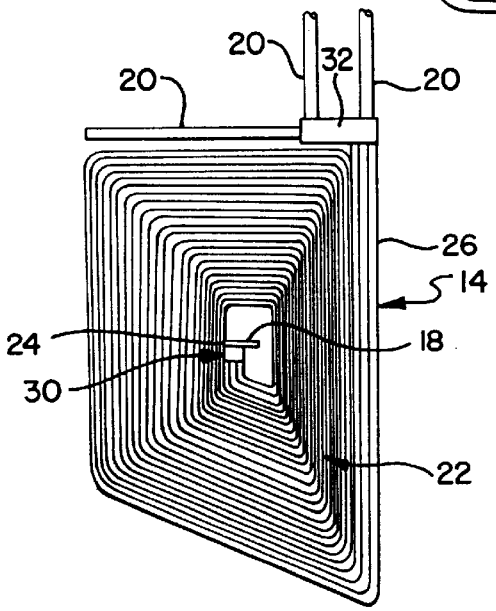
FIG. 4b
FIG. 5
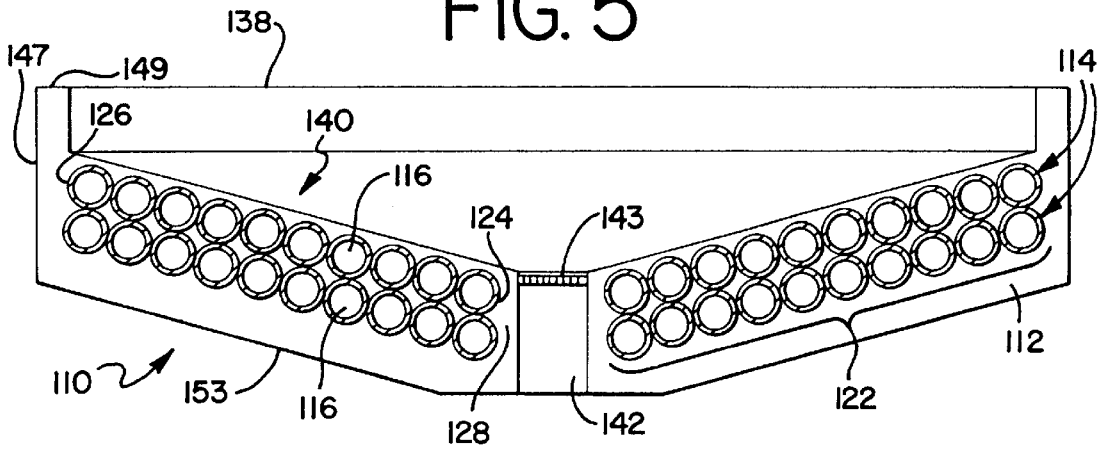

APPARATUS FOR COOLING FLUIDS

FIELD OF THE INVENTION

The present invention relates to an improved apparatus for dispensing cooled fluids, in particular beverages such as sodas.

BACKGROUND OF THE INVENTION

Devices for cooling beverages such as sodas are known. Typical known devices employ ice to cool a unit through which flow a plurality of fluid lines for carbonated water and one or more syrups. The cooled fluids are subsequently mixed and dispensed.

A need exists for an improved apparatus for dispensing cooled fluids, in particular beverages such as soft drinks.

SUMMARY OF THE PREFERRED EMBODIMENTS

In accordance with one aspect of the present invention, there is provided an apparatus for cooling at least one fluid. The apparatus includes at least one fluid system comprising at least one fluid line, and a metallic unit. The fluid system is arranged in the shape of a concavely depressed coil, that is, a coil having an inverted conical or curved shape with a top and a bottom. At the bottom of the coil an opening is defined. The metallic unit incorporates the at least one fluid system. The metallic unit has an upper surface in which is defined a concave depression, and the concave depression has defined therein a drain which extends through the metallic unit. The concave depression of the metallic unit is aligned with the concavely depressed coil, and the drain defined in the metallic unit passes through the opening at the bottom of the at least one fluid system.

In a preferred embodiment the coolant system comprises a plurality of nested fluid systems. The plurality of fluid systems are disposed one above the next, with their concave depressions conforming to each other and their bottom openings aligned. This enables the apparatus to cool a plurality of fluids, for example carbonated water and one or more beverage syrups, while the various fluids are kept separate during the cooling process.

In another preferred embodiment the at least one fluid system includes a plurality of fluid lines that extend in parallel between an inlet manifold and an outlet manifold.

In accordance with another aspect of the present invention there is provided a method of making an apparatus as described herein. The method includes the steps of forming at least one fluid system including at least one fluid line, the at least one fluid system having the shape of a concavely depressed coil with a top and a bottom in which is defined an opening, and forming a molded metallic unit by casting a liquefied metal about the at least one fluid system. The molded metallic unit has an upper surface in which is defined a concave depression aligned with the at least one fluid system. The concave depression has defined therein a drain which passes through the opening in the bottom of the at least one fluid system.

In accordance with a further aspect of the present invention there is provided a method of cooling a fluid. The method includes the steps of providing an apparatus for cooling a fluid as described herein; depositing a cooling medium in the concave depression formed in the metallic unit of the apparatus; and flowing a fluid through the fluid system of the apparatus. Preferably, the cooling medium deposited in the concave depression is ice.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which

FIGS. 4*a–b* are top plan and perspective views of an embodiment of a fluid system employed according to the present invention, showing three fluid lines connected to inlet and outlet manifolds, and three outlet sections connected to the outlet manifold.

FIG. 5 is a cross-sectional view of a second embodiment of an apparatus of the invention including two nested fluid systems having one fluid line each.

Like numerals refer to like parts throughout the several views of the drawings.

DETAILED DESCRIPTION OF THE PREFERRED EMBODIMENTS

Figure 1:
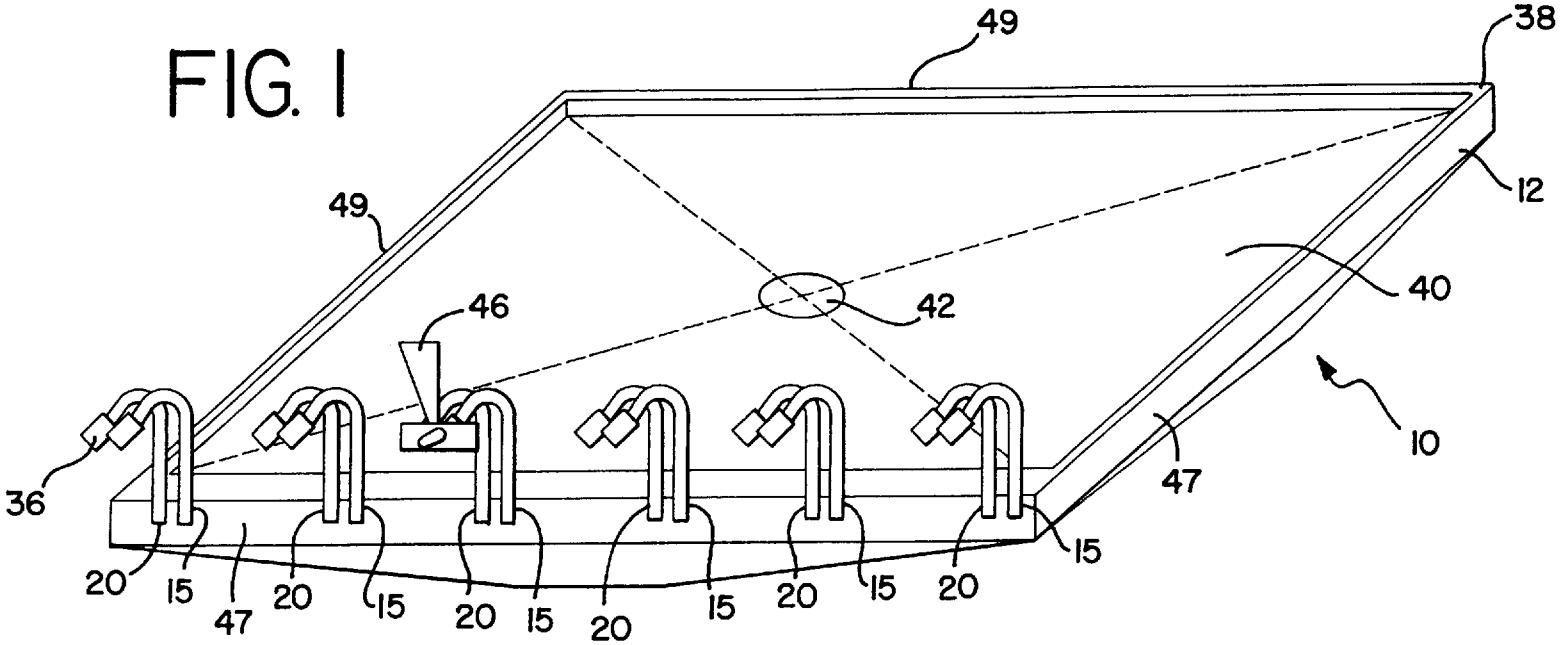
FIG. 1 is a perspective view of an embodiment of an apparatus of the present invention incorporating multiple fluid systems.
Figure 2:
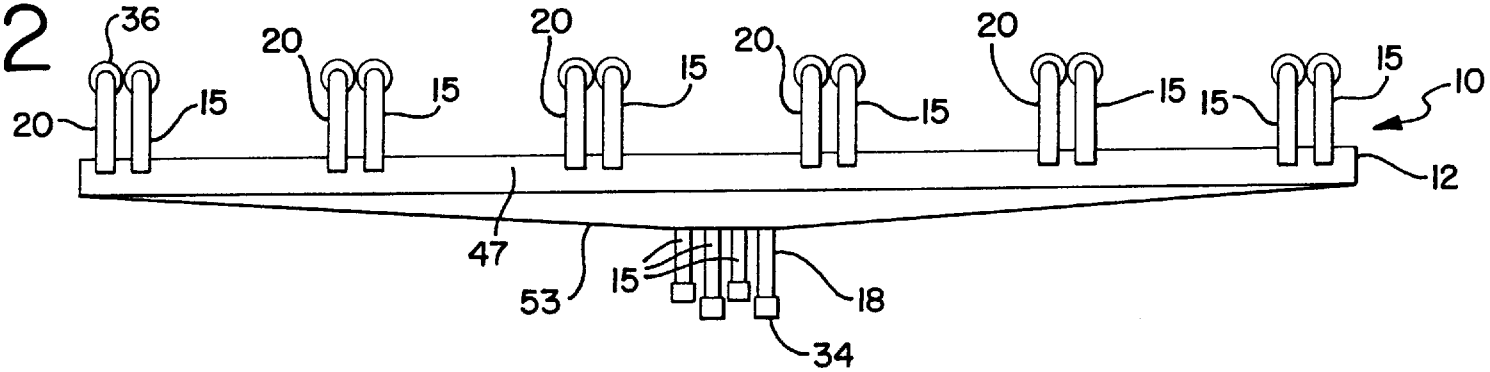
FIG. 2 is a side elevational view of the apparatus of FIG. 1
Figure 3:
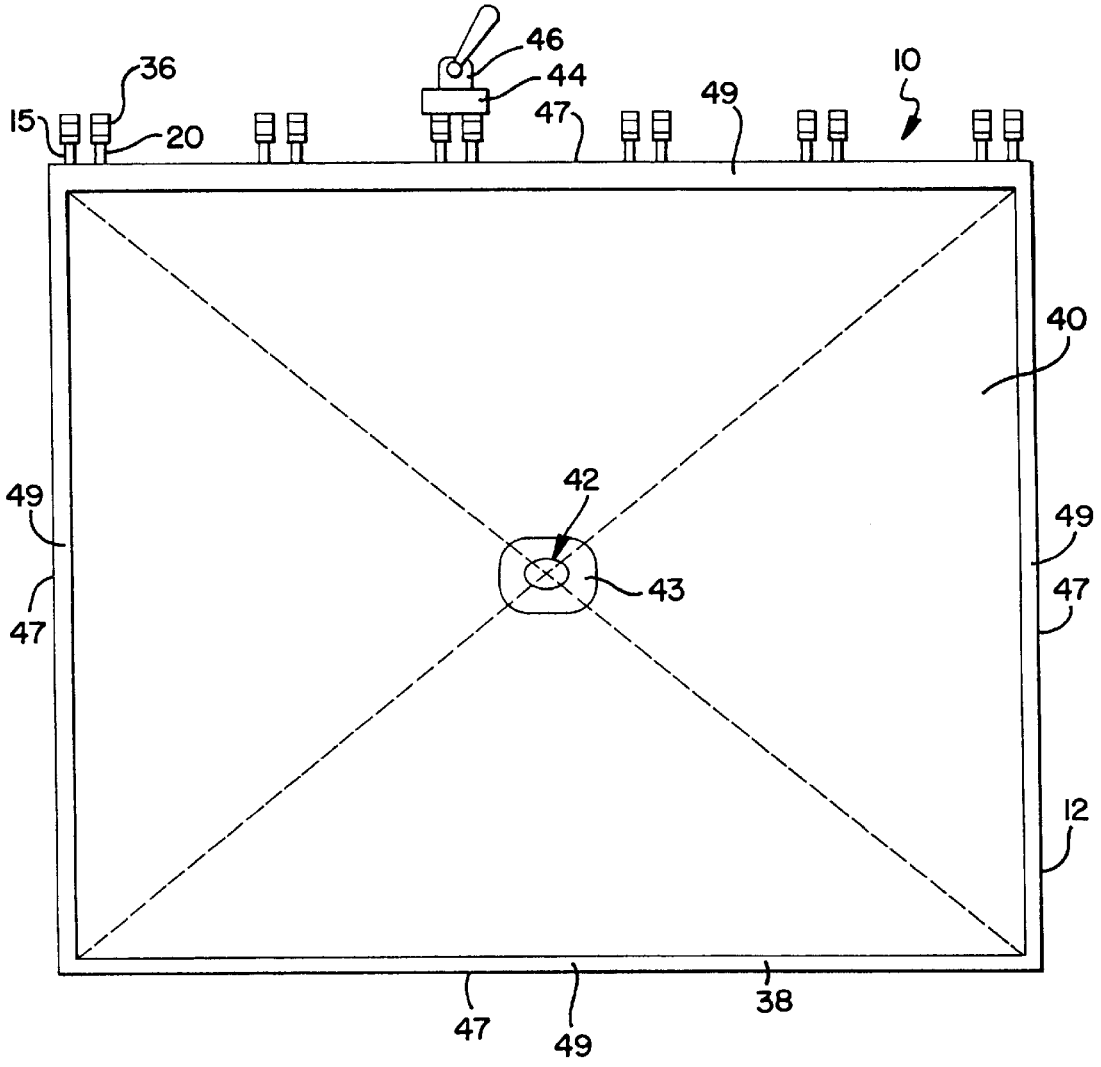
FIG. 3 is a top plan view of the apparatus of FIG. 1 showing a concave depression in the upper surface of the metallic unit and a drain at the bottom of the depression.

With reference to FIGS. 1–4*b* an embodiment of an apparatus 10 of the invention includes a metallic unit 12 within which is disposed at least one fluid system 14 (one of which is shown in FIGS. 4*a* and 4*b*). Fluid system 14 includes at least one fluid line 16 having an inlet section 18, at least one outlet section 20 and a concavely depressed coil 22 disposed between inlet section 18 and the at least one outlet section 20. Concavely depressed coil 22 has a bottom 24 and a top 26. "Concavely depressed" means meant that the coil 22 is formed such that the bottom 24 extends downward with respect to the top 26 of the coil 22 and is narrower than the top 26. Concavely depressed coils can have the shape, for example, of an inverted pyramid having a base with three or more sides (four are illustrated), an inverted right circular cone, an inverted spherical segment (i.e., a bowl shape), or the like. Preferably the concave depression so formed by the coil defines a volume having flat sides or sides that are curved inward. The concavely depressed coil configuration increases the surface area available for heat transfer in comparison with conventional flat coils.

A opening 28 is defined in the bottom 24 of concavely depressed coil 22. That is, the coil is not completely closed. The inlet section 18 of fluid line 16 is connected to the bottom 24 of coil 22, and the outlet section 20 is connected to the top 26 of coil 22.

Coil 22 can be formed by hand, but preferably is formed by using a multi-axis bending machine such as a Pneuform 6-axis bender (commercially available from Pneuform of London, England). Conventional single-plane benders are incapable of forming a concavely depressed coil useful in the present invention.

In a preferred embodiment, inlet section 18 of fluid system 14 is connected to inlet manifold 30, the at least one outlet section 20 (three are shown in FIG. 4*a*) is connected to outlet manifold 32, and fluid system 14 includes two or more fluid lines 16 which extend between inlet manifold 30 and outlet manifold 32.

The number of fluid lines 16 employed will vary depending on design choices such as the thickness of the metallic unit 12 within which the at least one fluid system 14 is to be incorporated, the number of separate fluid systems 14 to be employed, etc. The thicker the plate, the greater the total quantity of fluid (whether the same fluid or different fluids) that can be cooled. Thicker plates allow cooling of multiple different types of fluids, such as carbonated water in system 14 and syrups for beverages such as soft drinks, at the same time.

The number of fluid lines 16 in each fluid system 14 will typically vary between 1 and 4, more preferably 2 to 3, and typically 3 (see FIGS. 4*a–b*). Fluid line 16 is preferably from about 0.25 inch to about 1 inch in diameter, and very preferably about 0.375 inch in diameter. Two fluid systems 14 each with three outlets 20 are used for water in apparatus 10 and a six separate systems, each with one line 15, are used for six different syrups in apparatus 10. Three of the syrup line inlets and one of the water inlet sections 18 are hidden from view behind the other inlets in FIG. 4*b*.

Inlet manifold 30 and outlet manifold 32 are preferably about 0.375 inch to about 2 inches in diameter, very preferably about 0.75 inch in diameter. Typical manifold lengths range from about 3 to 5 inches. The lengths of the inlet and outlet manifolds are determined according to routine design factors such as the thickness of the coil 22 employed, the desired thickness of the metallic unit 12, etc.

Couplings 34 and 36 are affixed to the inlet sections 18 and outlet sections 20, respectively, of each fluid system 14. The inlet and outlet fittings can readily be selected by those skilled in the art. Exemplary outlets fittings include bumped fittings, swage fittings, ⅜ inch male fittings and ⅜ inch female fittings. Exemplary outlet fittings include those known to the art which are capable of coupling to the double O-ring fittings used by commercial soft drink vendors on conventional soft drink dispensing machine valves.

Fluid lines 16 and manifolds 30 and 32 preferably are formed from stainless steel, such as "304" (commercially available from Oakley Tubing, Denver, Colo.). Stainless steel is particularly preferred because it is capable of withstanding contact with molten metal, such as molten aluminum or aluminum alloys, which are preferably used to form the metallic unit according to the invention (as described below), without melting, deforming or reacting with the molten metal. Other metals which are similarly resistant, e.g., tungsten, titanium, noble metals, etc., can also be used if desired to form the fluid lines 16 and the manifolds 30 and 32.

The fluid lines 14 preferably are connected to the inlet and outlet manifolds 30 and 32, respectively, by welding. Welding is preferred in order to minimize the occurrence of leakage within the metallic unit 12 at the joints between the components of fluid system 14.

Metallic unit 12 preferably has a rectangular (including a square) perimeter. However, other perimeter shapes constitute routine design choices and as such are considered to be within the scope of the present invention. Metallic unit 12 has an upper surface 38 in which is defined by concave depression 40 and a bottom surface 53. Depression 40 can have a depth which preferably varies within a range from about one half inch to about ten inches. In a preferred embodiment the depth of depression 40 is about one inch. In the alternative, the local angle of slope of the walls of the depression 40 can vary between about 2 and 50°, preferably about 2 and 30°, and can be constant or variable (more particularly, decreasing from top to bottom). The bottom surface 53 preferably has a convex shape with faces paralleling those of concave depression 40 so that the thickness of metallic unit 12 is generally constant. As shown, the sides of metallic unit 12 include vertical faces 47 as well as raised edges 49 around the perimeter of upper surface 38.

At the bottom of depression 40 a drain 42 is formed. Drain 42 extends through the thickness of metallic unit 12. Preferably a screen 43 is disposed above or within drain 42 to prevent ice from blocking the drain.

At least one fluid system 14 is disposed beneath depression 40 of metallic unit 12. In a preferred embodiment, two with one fluid line 16 each or more fluid systems 14 (two are illustrated in the embodiment of FIG. 5) are so disposed in a nested manner, that is, one on top of the next, such that each concavely depressed coil is disposed within the depressed coil of the underlying fluid system 14 and the uppermost fluid system 14 is disposed beneath the surface of depression 40. Preferably, the thickness of the metallic unit above the uppermost fluid system 14 is about ⅛ to 1/16", and is relatively constant over the surface of the depression 40.

Preferably, three or more fluid systems 14 are employed. A first fluid system 14 preferably is employed to cool a supply of carbonated water, while the remaining fluid systems 14 are employed to cool supplies of beverage syrups. These cooled liquids are subsequently combined, for example in a conventional mixing valve 44 (FIG. 3), to produce soft drinks which are subsequently dispensed from tap heads 46.

Metallic unit 12 preferably is comprised of aluminum or an aluminum alloy. Typical useful aluminum alloys include 99.7% Al (P-10/20), as well as A356 or the like. Other metals, such as copper lead, or brass, could also be used, but such metals must be compatible with the materials used to form the fluid system(s) 14, and preferably have thermal conductivities similar to that of aluminum.

The metallic unit 12 is preferably formed by a standard "permanent molding" casting process. In an exemplary process, aluminum or a selected aluminum alloy is smelted in a smelting furnace. Meanwhile, at least one fluid system 14, and preferably a nested stack of two or more fluid systems 14, is placed in a mold having the desired shape of the metallic unit. Preferably, couplings 34 and 36 are connected to inlet section 18 and outlet section(s) 20, respectively, prior to placement of the fluid system(s) into the mold.

The mold is clamped shut, and the aluminum or alloy is ladled out from the smelting furnace into the mold. The casting temperature is approximately 1400° F. Once cast, the aluminum solidifies around the fluid system(s) 14.

The solidified metallic unit 12 is subsequently removed from the mold, excess aluminum is removed and recovered for recycling, and the metallic unit is cooled to ambient temperature. Finally, the metallic unit 12 is pressure tested for leaks, and passivated to de-scale deposits, particularly iron oxide, from the interior of the coolant and fluid lines, using a standard process such as flowing a nitric/phosphoric acid mixture through the coolant and fluid lines.

In use, a cooling medium, preferably ice, dry ice, etc., most preferably ice, is disposed within depression 40 of metallic unit 12 and cools metallic unit 12 and fluid system (s) 14 disposed therein. A fluid to be cooled, such as carbonated water or a beverage syrup, is introduced into each fluid system 14 and flows upwardly from inlet. section 18 through coil 22 and outlet section 20, and subsequently out of metallic unit 12. The temperature of the fluid to be cooled is typically ambient or room temperature. As each fluid flows upwardly through its respective fluid system 14, the cooling medium located in depression 40 cools the fluid(s). When ice is employed, as warm fluid flows through each fluid system 14, heat is transferred from the fluid to the ice. The ice begins to melt, and the liquid water so produced flows down the walls of depression 40 and out through drain 42. As the fluid flows upwardly it cools, but remains at a temperature above that of the ice, allowing heat transfer to continue. An efficient counter current heat exchange is thereby established.

FIG. 5 shows a second apparatus 110 very similar to apparatus 10. Reference numbers with an addend of 100 are thus used to label the components of apparatus 110 that are similar to the components identified in FIGS. 1–4*b*. Apparatus 110 only includes two fluid systems 114 with only one fluid line 116 each. Inlets, outlets and manifolds are not shown for sake of clarity.

What is claimed is:

1. An apparatus for cooling at least one fluid comprising:

i) at least one fluid system comprising at least one fluid line having an inlet and an outlet, said fluid system being arranged in the shape of a concavely depressed coil, said coil having a top and a bottom at which an opening is defined; and ii) a metallic unit which incorporates said at least one fluid system, said metallic unit having an upper surface in which is defined a concave depression, a bottom surface opposite said upper surface, and sides, said concave depression having further defined therein a drain which extends through said metallic unit, wherein said at least one fluid system is disposed within said metallic unit such that said concave depression of said metallic unit is aligned with said concavely depressed coil, said fluid line inlet extends from the bottom surface of said metallic unit, said fluid line outlet extends from a side of said metallic unit, and said drain defined in said metallic unit passes through said opening at a bottom apex of said at least one fluid system.

2. The apparatus of claim 1 comprising a plurality of nested fluid systems.

3. The apparatus of claim 1 wherein said fluid system comprises a plurality of fluid lines extending in parallel between an inlet manifold and an outlet manifold, said fluid line inlet comprising an inlet to the inlet manifold and said fluid line outlet comprising an outlet to the outlet manifold.

4. The apparatus of claim 3 wherein said fluid system has a top and a bottom, and wherein said inlet manifold is located at said bottom of said fluid system and said outlet manifold is located at said top of said fluid system.

5. The apparatus of claim 1 wherein said concavely depressed coil has a shape which is pyramidal or curved.

6. The apparatus of claim 1 wherein said fluid system is comprised of stainless steel.

7. The apparatus of claim 1 wherein said metallic unit is comprised of aluminum or an aluminum alloy.

8. A method of cooling a fluid comprising the steps of:

a) providing an apparatus for cooling a fluid as claimed in claim 1;

b) depositing a cooling medium in said concave depression formed in said metallic unit of said apparatus; and c) flowing a fluid through said fluid system of said apparatus.

9. The method of claim 8 wherein said cooling medium is ice.

10. The method of claim 8 wherein said fluid is selected from the group consisting of water and a soft drink syrup.

11. The method of claim 8 wherein the apparatus comprises a plurality of fluid systems and water flows through at least one fluid system and a soft drink syrup flows through a separate fluid system.

12. The method of claim 11 wherein the apparatus comprises at least three fluid systems, and at least two different soft drink syrups each flow through a separate fluid system.

13. The apparatus of claim 1 wherein said concave depression is at least partially defined by a surface having a slope and wherein said concavely depressed coil has a slope substantially similar to said slope of said surface.

14. The apparatus of claim 1 comprising a plurality of fluid systems, each of the fluid systems having at least one fluid line with a fluid line inlet extending from the bottom surface of the metallic unit and a fluid line outlet extending from a side of the metallic unit.

15. The apparatus of claim 1 wherein all fluid lines within the metallic unit run in lengths parallel to one another and do not cross over one another.

16. The apparatus of claim 1 wherein the sides of the metallic unit each comprise a vertical face and a raised edge.

17. The apparatus of claim 16 wherein the fluid line outlet extends from the side vertical face.

18. A method of making an apparatus for cooling at least one fluid comprising the steps of:

a) forming at least one fluid system comprising at least one fluid line having an inlet and an outlet, said at least one fluid system having the shape of a concavely depressed coil with a top and a bottom in which is defined an opening; and b) forming a molded metallic unit by casting a liquefied metal about said at least one fluid system, said molded metallic unit having an upper surface in which is defined a concave depression aligned with said at least one fluid system, a bottom surface opposite said upper surface, and sides, said concave depression having defined therein a drain which passes through said opening in said bottom of said at least one fluid system and said fluid line inlet extending from the bottom surface of said metallic unit and said fluid line outlet extending from a side of said metallic unit.

19. The method of claim 18 wherein in step (a) a plurality of nested fluid systems are formed and in step (b) said molded metallic unit is formed by casting said liquefied metal about said plurality of nested fluid systems.

20. The method of claim 10 wherein the sides of the metallic unit each comprise a vertical face and a raised edge and the fluid line outlet extends from the vertical face.

* * * * *